United States Patent [19]

Igel

[11] 4,319,450

[45] Mar. 16, 1982

[54] PNEUMATICALLY CUSHIONED SPINNING RING SYSTEM

[75] Inventor: Wolfgang Igel, Ebersbach, Fed. Rep. of Germany

[73] Assignee: Zinser Textilmaschinen GmbH, Ebersbach, Fed. Rep. of Germany

[21] Appl. No.: 919,455

[22] Filed: Jun. 27, 1978

Related U.S. Application Data

[63] Continuation-in-part of Ser. No. 904,907, May 11, 1978, abandoned.

[30] Foreign Application Priority Data

May 12, 1977 [DE] Fed. Rep. of Germany ..... 2721360

[51] Int. Cl.[3] ..... D01H 7/56; D01H 15/00; D01H 1/24

[52] U.S. Cl. ..... 57/261; 57/75; 57/78; 57/124

[58] Field of Search ..... 57/34 R, 75, 78, 101, 57/124, 122, 261–263

[56] References Cited

U.S. PATENT DOCUMENTS

| | | | |
|---|---|---|---|
| 2,932,152 | 4/1960 | Jackson | 57/101 X |
| 3,324,643 | 6/1967 | Kluttz | 57/101 X |
| 3,494,120 | 2/1970 | Chilpan et al. | 57/124 X |
| 3,543,503 | 12/1970 | Watabe et al. | 57/124 X |
| 3,611,697 | 10/1971 | Greb | 57/124 |
| 4,023,342 | 5/1977 | Schenkel | 57/124 X |

*Primary Examiner*—John Petrakes
*Attorney, Agent, or Firm*—Karl F. Ross

[57] ABSTRACT

The individual spinning rings of a ring-spinning or yarn-doubling machine frame, which are supported via a pneumatic cushion upon the respective ring holder and upon which a traveler is adapted to orbit, have compressed air introduced initially to support the rings. The compressed-air injection is interrupted when the rings reach a rotational speed enabling them to draw in the air for the cushion (self-sustaining airborne support cushion). Manually operated valves individual to each ring are in respective branch ducts and are provided for individual startup while a central control is provided for all of the rings.

6 Claims, 5 Drawing Figures

PNEUMATICALLY CUSHIONED SPINNING RING SYSTEM

CROSS-REFERENCE TO RELATED APPLICATION

This application is a continuation-in-part of Ser. No. 904,907 filed May 11, 1978, now abandoned.

FIELD OF THE INVENTION

The present invention relates to an improved method of operating the individual airborne rings of a ring-spinning, yarn-doubling or twisting machine, to a method of starting the individual rings and to a ring installation or system in which the rings are pneumatically supported on respective ring holders and are adapted to carry respective travelers.

BACKGROUND OF THE INVENTION

Spinning, twisting or doubling machines have been provided heretofore with individual ring assemblies each comprising an annular ring holder on the ring rail of a spinning, doubling or twisting frame. The assembly includes an annular spinning, doubling or twisting ring which can rotate relative to the holder, being suspended or supported thereon by a pneumatic cushion. A traveler engaged by the yarn is designed to orbit around the upper rim of this ring.

Assemblies of this type are described, for example, in U.S. Pat. No. 3,324,643, British Pat. No. 1,000,365, German Federal Republic Open Application (Offenlegungsschrift) DT-OS 24 09 146, and German Democratic Republic patent No. 40 910.

A ring spinning machine or doubling machine which is in operation and has spinning rings which are rotatably supported on pneumatic cushions and are set in rotation by ring travelers can admit compressed air into the bearing gaps between the spinning rings and their support bearings in the ring frame when the spinning rings are stationary to produce an air cushion adapted to support the spinning rings. The admission of compressed air is interrupted if the spinning rings, adapted to displace air, are themselves able to draw in the air required for maintaining the air cushion after reaching a minimum rotational speed.

The starting of the spinning ring is performed aerostatically in such so-called hybrid bearings, i.e. by the admission of compressed air and building up an air cushion which supports the spinning.

To this end a compressed-air supply line, connected by means of a control valve to a source of compressed air and with branch lines extending in to the air gaps of all spinning rings, extends along the ring frame.

Immediately prior to starting the entire machine and by opening of the central valve all spinning rings are biased with compressed air and are able to start. The spinning ring is then aerodynamically operated after it has reached a specific minimum rotational speed at which it is able itself to draw in its bearing air and the supply of compressed air can be restricted or completely shut off by closing of the valve.

The spinning ring is set into rotation by means of the traveler which is entrained by the spindle through the thread or yarn. The drive of the spinning ring is therefore conditional upon the presence of the thread.

Accordingly, the spinning ring comes to a stop if the thread breaks and must be restarted after the thread break is remedied, i.e. the ends are tied. However, since the entire machine will then be in normal operation and the supply of compressed air will be shut down, restarting is not readily possible.

OBJECTS OF THE INVENTION

It is the principal object of the present invention to provide a method of and a device for obviating the aforementioned drawback of earlier hybrid airborne ring assemblies at low cost and without impeding the operation of assemblies which have not shut down because of yarn breakage.

Another object is to provide an improved method of operating a spinning or doubling machine of the type described.

Still another object is to provide an improved ring spinning or doubling machine which readily permits restarting of a stopped individual assembly with self-sustaining air cushions or bearings.

It is therefore also an object of the invention to be able, for example after remedying a thread break, to restart an individual, pneumatically supported spinning ring in a ring spinning or ring doubling machine from its rest position even if the remainder of the machine is already in operation with spinning rings which are running aerodynamically, i.e. without the supply of compressed air.

It is another object to extend the principles of the original application to another embodiment.

SUMMARY OF THE INVENTION

These objects and others which will become apparent hereinafter are attained by providing individual to each ring assembly or to small groups of ring assemblies less than all of a particular row of such assemblies in a common frame or on a common ring rail, respective branch ducts and valves which can be selectively operated, preferably manually, to re-establish the respective support cushion in the case of standstill of a respective ring.

Preferably one such valve and branch duct connected to the source of compressed air is provided for each ring assembly and is individual thereto so as to be actuatable independently of the other valves and hence while the supply of compressed air to the operating rings remains cut off, thereby feeding compressed air only to the ring bearing which has been immobilized by thread breakage and the termination of induced rotation of the corresponding traveler and ring by a ballooning thread.

Thus the problem is solved by the procedure which is adopted for starting the entire machine being applied to starting of an individual spinning ring, namely only with reference to the affected ring or in other cases with reference to a group of rings which contains the affected ring but is smaller than the total number of all spindles of the machine.

In other cases the procedure is applied to all rings of the machine.

In procedural terms preference is to be given to the first-mentioned method because with the last-mentioned method of operation it is possible under specific spinning conditions that the mode of operation of normally running spinning points may be detrimentally affected by the change of bearing friction resulting from the introduction of compressed air. The procedure mentioned in the second place represents a compromise which is advantageous in some cases.

The last mentioned method can be advantageous in those cases in which it may not be practical to provide means other than those which must in any case be present. By contrast, the first-mentioned method of operation calls for additional means specific to the ring and somewhat more expensive because of the large number of extra items (valves and branch ducts) required.

BRIEF DESCRIPTION OF THE DRAWING

The above and other objects, features and advantages of the present invention will become more readily apparent from the following description, reference being made to the accompanying drawing in which.

SPECIFIC DESCRIPTION

The routine of stopping and recommencing operation of an individual spinning ring in a machine which is in operation will first be explained by reference to FIG. 1.

Figure 1:
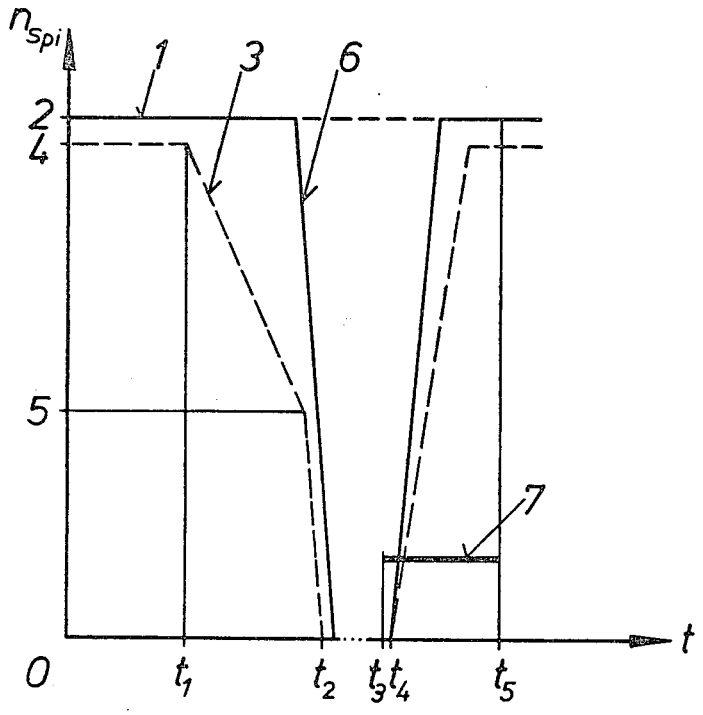
FIG. 1 is a speed/time graph relating to the routine of stopping and recommencing operation of an individual ring.

In FIG. 1 the time t is plotted on the abscissa and the rotational speed $n_{Spi}$ of the spindle or of the ring is plotted on the ordinate.

The operational speed 1 of the spindle is assumed to have the value 2, the rotational speed 3 of the spinning ring has the operating value 4 and the speed difference "2 minus 4" corresponds to the lag of the rotor for the purpose of winding on the thread supplied to it and it will be understood that the aforementioned difference depends on the thread delivery speed, the winding-on diameter and other factors and by contrast to the simplified illustration described is seldom constant.

In the event of breakage at the time $t_1$ on the spinning point of a thread whose spinning ring speed is shown in the graph, the spinning ring will lose its drive and reduce its rotational speed because of the bearing friction in the air cushion.

The spinning ring speed 3 drops gradually until it reaches a point at the value 5 at which the spinning ring is no longer able to draw in its own bearing air and the air cushion between the spinning ring and its holder in the ring frame collapses entirely. A substantially higher mechanical friction will then occur between the spinning ring and the mating bearing which said friction rapidly brings the spinning ring to a stop at the time $t_2$.

The thread break can be remedied during the time $t_2$ to $t_3$, which can be of any desired length and during which the speed of the spindle associated with the affected spinning ring is reduced to zero as shown at 6.

When the thread break is remedied the supply 7 of compressed air into the bearing gap of at least the affected spinning ring is switched on at the time $t_3$ and the aerostatic air cushion which supports the spinning ring is built up.

Operation of the spindle is released at the time $t_4$ and it rapidly reaches its operating speed 1. The spinning ring immediately commences movement on its air cushion but accelerates more slowly. The supply of compressed air can be shut down at the time $t_5$.

Figure 2:
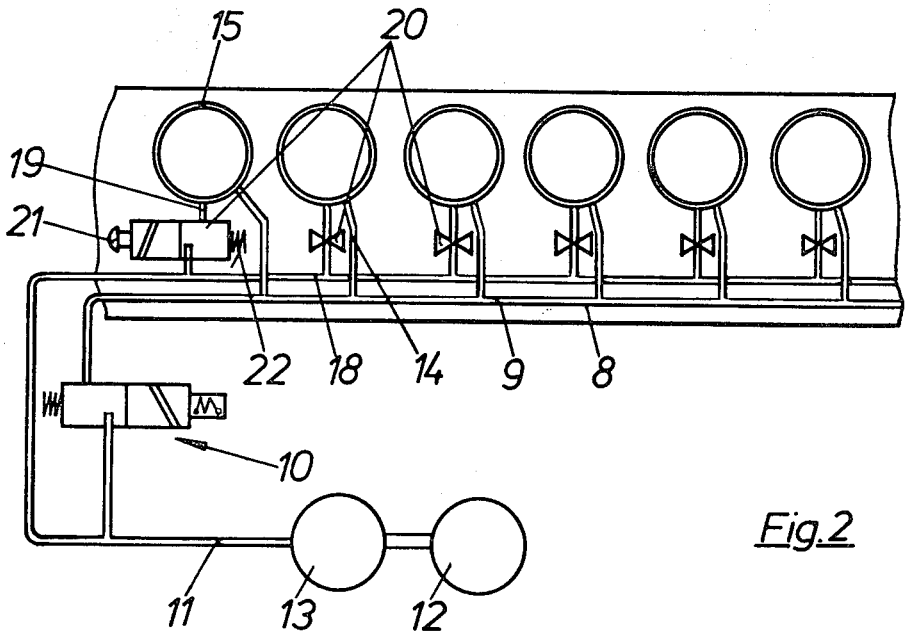
FIG. 2 is a duct layout diagram of a first embodiment of the apparatus according to the invention.
Figure 5:
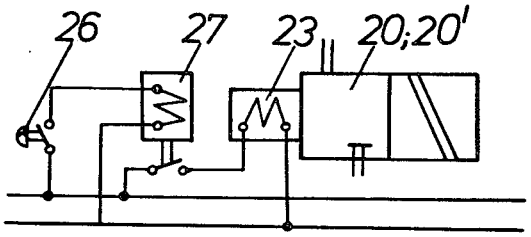
FIG. 5 is the circuit diagram of a third embodiment of the invention.
Figure 3:
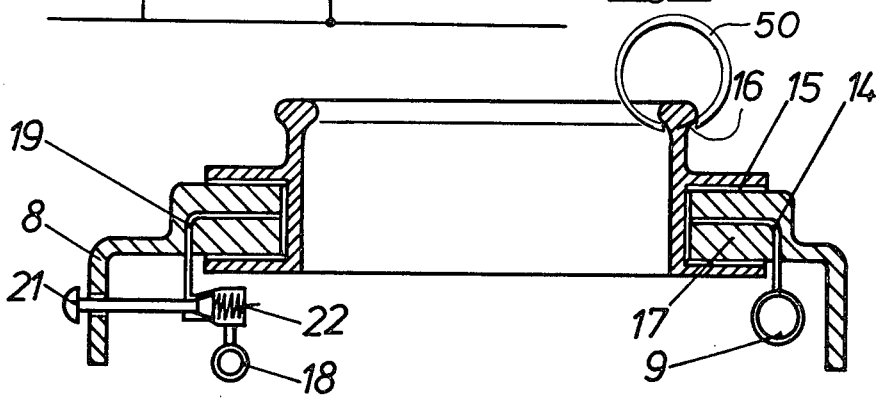
FIG. 3 is a cross-section through a ring frame of the embodiment according to FIG. 2.

The compressed air duct 9 into which compressed air can be introduced by means of a valve 10 via a supply line 11 from a compressed-air source, for example comprising a motor 12 and compressor 13, extends along a ring rail 8 shown in FIGS. 2 and 3 for the purpose of the initially mentioned procedure for starting up the entire machine, i.e. for the combined starting of all spinning rings of a machine. The compressed air duct 9 extends by means of branch ducts 14 into bearing gaps 15 between spinning rings 16 and their mating bearings 17 in the ring rail 8 at all spinning points of the machine. The traveler is shown at 50.

On operating the valve 10 prior to taking the machine into operation compressed air flows into the bearing gaps 15 of all spinning rings where it builds up the air cushions on which the spinning rings 16 immediately and readily rotate when the spindles are started. The supply of compressed air is shut down by closing the valve 10 after the speed is reached at which the bearing surfaces of air delivering construction and associated with the spinning rings 16 are able themselves to draw in their bearing air.

If, now, a single spinning ring is to be started operating from the rest, i.e. is to be set into rotation with self-suction of the bearing air, i.e. without the supply of compressed air, when all other spinning rings 16 are in normal operation it is also possible by operation of the valve 10 to admit compressed air into the bearing gaps of all spinning rings 16 including the spinning ring which is to be taken into operation. The valve can be again closed when the affected spinning ring has reached its self-suction speed.

However it is preferred to provide a second compressed-air duct 18 which extends along the ring rail 8, communicates constantly with the source of compressed air 12, 13 via the supply duct 11 and therefore constantly contains compressed air.

The compressed-air duct 18 also communicates by means of branch ducts 19 into the bearing gaps 15 of all spinning rings 16 of the machine.

A valve 20, of which only one is shown diagrammatically in FIG. 2, is disposed in each of said branch lines and the other identically constructed valves are merely indicated. The valves 20 are opened manually by means of a knob 21 against the force exerted by a spring 22.

To start a single spinning ring 16 only the valve 20 associated with the affected spinning ring is actuated and accordingly the air cushion required for starting is built up only on the spinning ring by the supply of compressed air.

Figure 4:
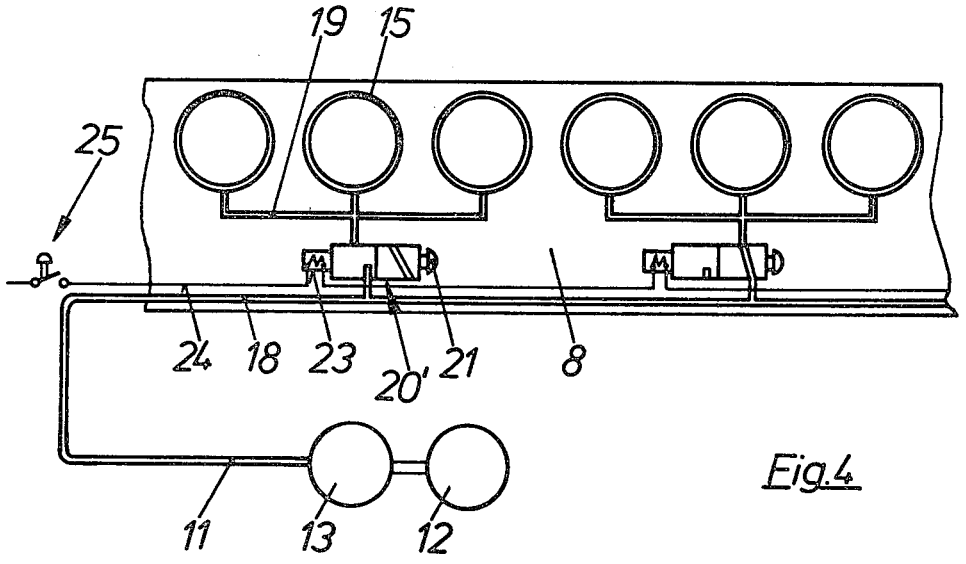
FIG. 4 is a duct layout diagram of a second embodiment of the apparatus according to the invention.

In FIG. 4 the valve 20' is common to a group of spinning rings—three spinning rings in the illustration—so that the number of valves required for an entire machine is reduced by a third. On starting a single spinning ring 16 the valve 20' associated with the group of spinning rings containing the affected spinning ring is actuated.

Instead of being actuated manually by means of the knob 21 the valves 20' of FIG. 4 can also be actuated by means of electromagnets 23 which can be energized together via a conductor 24 by the manual closing of a switch 25. To start all spinning rings 16 of the machine all valves 20' can be operated together by closing the switch 25 in this embodiment and the bearing gaps 15 of all spinning rings can thus be simultaneously supplied with compressed air. It is therefore possible to dispense with the compressed-air duct 9 of FIGS. 2 and 3 which is intended for the combined starting of all spinning rings 16.

It will be understood that the central controllability of the group valves 20' according to FIG. 4 can also be applied to the individual valves 20 in FIGS. 2 and 3.

To obviate the need for depressing the pushbuttons 21 for the entire duration of the procedure for switching on the valves to supply compressed air when remedying a thread fraction and for starting the affected spinning ring—the hand required to this end would not be available for the manupulations to be carried out—it is possible according to FIG. 4 to provide that the valves 20, 20' are switched on by means of pushbuttons 26 which close a control relay 27, also constructed as a delay relay which connects the electromagnet 23 to the current source. After operation of the control relay 27 it holds itself for a specific adjustable time which corresponds to the time normally necessary for remedying a thread break and for accelerating the spinning ring to the operating speed. After the time has elapsed the control relay 27 drops out, disconnects the electromagnet 23 from the current source and thus closes the valves 20, 20'. Where appropriate the electromagnet 23 can also be provided with self-holding means which remain effective for a specific time.

I claim:

1. In a method of starting an individual stopped spinning ring of a ring spinning machine or doubling machine which is in operation and has a plurality of spinning rings which are rotatably supported on pneumatic cushions and have been set in rotation by respective travelers and in which compressed air has initially been admitted into the bearing gaps between the spinning rings and their support bearings in the ring frame when the spinning rings are stationary, to produce an air cushion adapted to support the spinning rings, and in which the admission of compressed air is interrupted when the spinning rings, which are adapted to draw in air, are themselves able to draw in the air required for maintaining the air cushion after reaching a minimum rotational speed, the improvement which comprises the steps of:

admitting compressed air to the support bearings of at least the said individual stopped spinning ring;

entraining the stopped ring rotatably by its traveler into rotation and increasing the speed of the ring at least to said minimum rotational speed; and cutting off the compressed air feed to said individual ring upon its attainment of said minimum speed.

2. The improvement defined in claim 1 wherein compressed air is admitted to the support bearings of a part of the total number of rings in the machine, said part including said individual spinning ring.

3. The improvement defined in claim 1 wherein the starting of a single spinning ring of the plurality of spinning rings of a ring spinning or ring doubling machine in operation is performed on all spinning rings of the machine.

4. A method of operating a ring frame comprising a multiplicity of ring assemblies along a ring rail, each of said assemblies including a ring holder and a ring rotatable in the respective holder and adapted to be entrained with a respective traveler by a thread engaging same and driven by a spindle, said method comprising the steps of:

(a) simultaneously introducing compressed air between each ring and the respective ring holder to establish a respective air cushion therebetween and enable rotation of the respective ring by entrainment with a traveler;

(b) upon the development of a sufficient rotary speed of all of said rings, terminating the supply of compressed air to all of said cushions and inducing air into same solely by the induced rotation of each ring, a thread break at one of said assemblies terminating the induced rotation of the ring of said one of said assemblies and the collapse of the respective air cushion;

(c) repairing the thread breakage at said one of said assemblies while permitting the remaining assemblies to continue to operate with self-sustaining air cushions; and (d) admitting compressed air between the ring and holder of said one of said assemblies to re-establish the respective air cushion and restart rotation of the latter ring upon repair of said thread breakage.

5. The method defined in claim 4 wherein compressed air is admitted to said one of said assemblies in step (d) to the exclusion of others of said assemblies.

6. In an apparatus for ring spinning or doubling, the combination which comprises:

(a) an elongated ring rail;

(b) a multiplicity of ring assemblies spaced along said ring rail, each of said assemblies including:

($b_1$) an annular ring holder, and ($b_2$) a ring rotatable relative to said holder and defining a gap therewith, each of said rings being entrainable by a traveler thereon engaged by a thread rotatable by a respective spindle;

(c) a source of compressed air;

(d) first means connecting said source with all of said gaps simultaneously for supporting all of said rings on respective air cushions to enable rotation of the rings, said first means being disconnectable from said gaps and said rings being constructed to induce air into the respective gaps upon rotational entrainment of said rings; and (e) second means connected with said source and selectively connectable with said gaps for admitting air to the gap of at most only a part of the assemblies to which said first means is connected, thereby enabling restarting of an assembly of said part suffering thread breakage.

* * * * *